US005218875A

United States Patent [19]

Volpe et al.

[11] Patent Number: 5,218,875

[45] Date of Patent: Jun. 15, 1993

[54] COMBINATION GLASS/PLASTIC PIPET TIP ASSEMBLY

[76] Inventors: Stephen J. Volpe, 4077 Eureka St.; John C. Bonino, 2057 E. Chestnut Ave., Apt. #7, both of Vineland, N.J. 08360

[21] Appl. No.: 819,838

[22] Filed: Jan. 13, 1992

[51] Int. Cl.[5] ..... B01L 3/02

[52] U.S. Cl. ..... 73/864.01; 222/568

[58] Field of Search ..... 222/159, 420, 527, 567, 222/569; 73/864.01, 864.14; 239/71, 390, 606, DIG. 19

[56] References Cited

U.S. PATENT DOCUMENTS

| | | | |
|---|---|---|---|
| 1,791,829 | 2/1931 | McCrackan | 222/420 X |
| 2,836,979 | 6/1958 | Ryley | 73/864.14 |
| 2,959,964 | 11/1960 | Streitfeld | 73/864.14 |
| 3,406,573 | 10/1968 | Burke | 73/864.14 X |
| 3,525,264 | 8/1970 | Nieglos et al. | 73/864.14 |
| 4,116,068 | 9/1978 | Megahed | 73/864.01 |
| 4,570,858 | 2/1986 | Bintner et al. | 239/71 X |
| 4,721,680 | 1/1988 | Jeffs et al. | 222/527 X |
| 4,748,859 | 6/1988 | Magnussen, Jr. et al. | 73/864.01 |
| 5,121,642 | 6/1992 | Davidowicz et al. | 73/864.01 X |
| 5,125,544 | 6/1992 | Millner et al. | 222/420 X |

*Primary Examiner*—Andres Kashnikow
*Assistant Examiner*—Kenneth Bomberg
*Attorney, Agent, or Firm*—James & Franklin

[57] ABSTRACT

The assembly tip includes a nozzle which has a cylindrical glass body with a tapered end portion. The non-tapered end of the nozzle is adapted to press fit into one end of a polypropylene collar. The collar has an internal lip, spaced from the end, which functions as a stop. The other end of the collar has an enlarged internal diameter adapted to receive a pipettor.

2 Claims, 2 Drawing Sheets

COMBINATION GLASS/PLASTIC PIPET TIP ASSEMBLY

The present invention relates to pipette tips and more particularly to a two part disposable pipette tip assembly which includes a glass nozzle and a polypropylene collar.

Glass pipettes have long been used in laboratories for removing, transferring and/or measuring small amounts of liquid. In order to reduce risks of cross-contamination and to reduce sample carry-over, disposable tips adapted to fit on the end of the pipette are often utilized. Such tips are commonly made of plastic material.

Commercially available disposable pipet tips are often formed of two plastic parts which are joined together to form an assembly. These parts are in the form of plastic nozzle tapered to a fine point and a plastic mounting collar. The collar may also be tapered so it can be received on the tapered end of a conventional pipettor.

This type of plastic pipette tip assembly has the advantage of being less expensive to manufacture then a glass tip, it is much less fragile than a glass tip and can friction fit over the end of a pipettor for easy installation and removal. However, plastic is reactive with many organic solvents. A pipette tip made out of plastic cannot therefore be used when organic solvents are involved.

Glass has fewer extractibles and is organic solvent resistant as compared to any plastic other than teflon. Teflon is not suitable for use as a disposable pipette tip because it is too expensive.

Glass has the additional advantage over plastic in that it is transparent. This permits accurate observation of the solvent as it is drawn by the pipettor.

It is a general object of the present invention to provide a disposable pipette tip assembly which is less expensive to manufacture than a glass tip, is less fragile than a glass tip, can be easily friction fitted over the end of a pipettor and at the same time can be used with organic solvents. Our invention takes advantage of the best properties of both plastic and glass as well as the transparent nature of the glass nozzle part to enable the user to avoid contact between the plastic collar portion of the tip assembly and the liquid situated in the tip assembly.

Moreover, the plastic collar portion of our invention may be color coded to indicate the size of the assembly. This color coding does not obscure the view through the glass nozzle portion and provides an easy way to sort the assemblies by size.

It is, therefore, a prime object of the present invention to provide a combination glass and plastic pipet tip assembly which is inexpensive enough to be disposable, is less fragile than a glass tip and may be used with organic solvents.

It is another object of the present invention to provide a combination glass and plastic pipet tip assembly in which the transparent nature of the glass of the nozzle portion permits accurate observation of the liquid.

It is another object of the present invention to provide a combination glass and plastic pipet tip assembly which can be color coded.

In accordance with the present invention, a pipette tip assembly is provided including a glass nozzle and a plastic collar. The nozzle comprises a substantially cylindrical body. One end portion of the body has an exterior surface with a given outer diameter. The other end is tapered. The collar comprises a substantially cylindrical body having a one end portion for mounting the assembly and a second end portion for receiving the non-tapered end of the nozzle body. The second end portion of the collar body comprises an interior surface and an end. The interior surface of the second end portion of the collar body has a diameter slightly smaller than the outer diameter of the non-tapered end of the nozzle body, such that the second end portion of the collar body expands when the non-tapered end the nozzle body is received therein. Protrusion means are situated in the interior surface of the second end portion of the collar body, at a location spaced from the end of the collar body. The second end portion of the nozzle body is adapted to be received within the second end of the collar body, with the end proximate to the protrusion means.

The protrusion means preferably comprises an annular lip. The lip functions as a stop to control the amount which the nozzle can be inserted into the collar.

The nozzle body has a given thickness. The protrusion means extends from the interior surface of the end portion of the collar body a distance substantially equal to the given thickness.

The end portion of the collar body has an outwardly flared portion. The collar preferably comprises a resilient material such as polypropylene.

The assembly is designed for use with a pipettor having an end. Means situated in the collar body are provided for preventing insertion of the pipettor end beyond the end portion of the collar body. The end portion of the collar body has an inner diameter which is slightly larger than the inner diameter of the rest of the collar body. An annular corner is formed between the end portion and the rest of the collar body.

To these and such other objects which may hereinafter appear, the present invention relates to a combination glass and plastic pipet tip assembly, as described in detail in the following specification and recited in the annexed claims, taken together with the accompanying drawings, when like numerals refer to like parts and in which:

Figure 1:
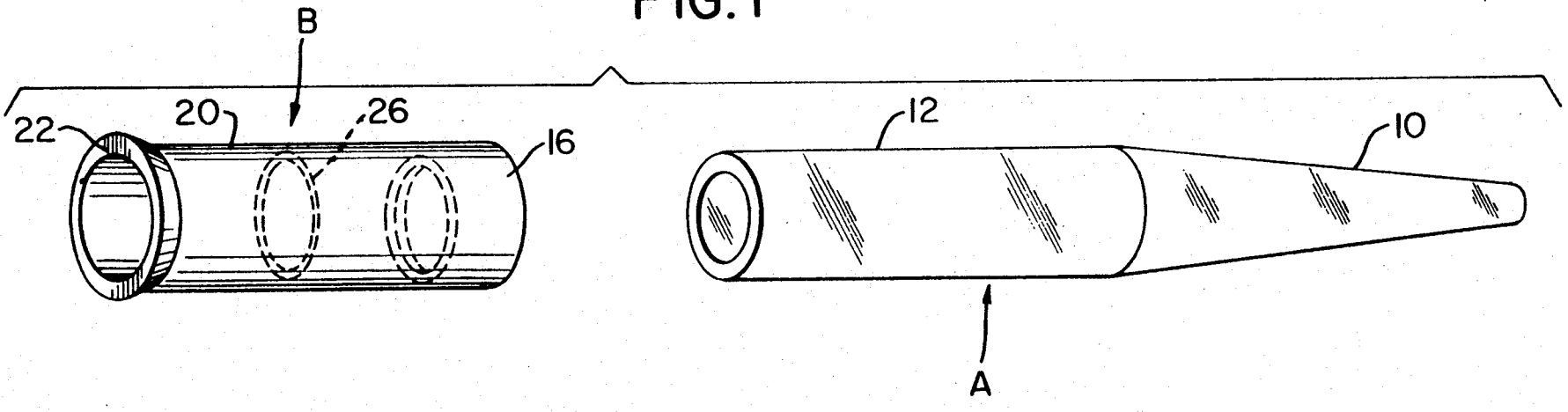
FIG. 1 is an exploded isometric view of the pipet tip assembly of the present invention.
Figure 2:
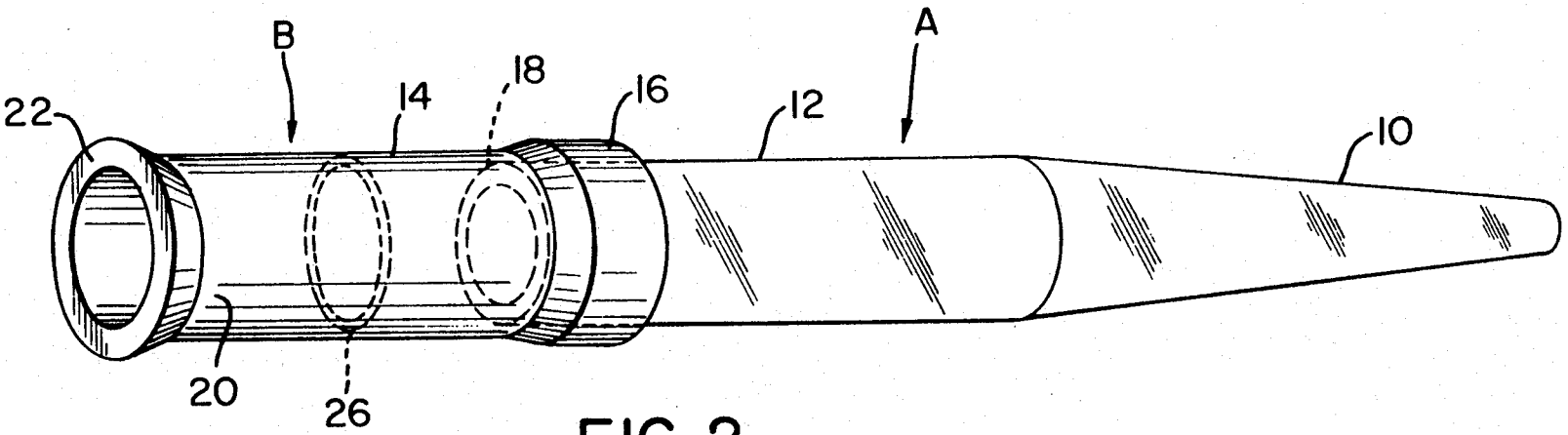
FIG. 2 is an isometric view showing the pipet tip assembly.
Figure 3:
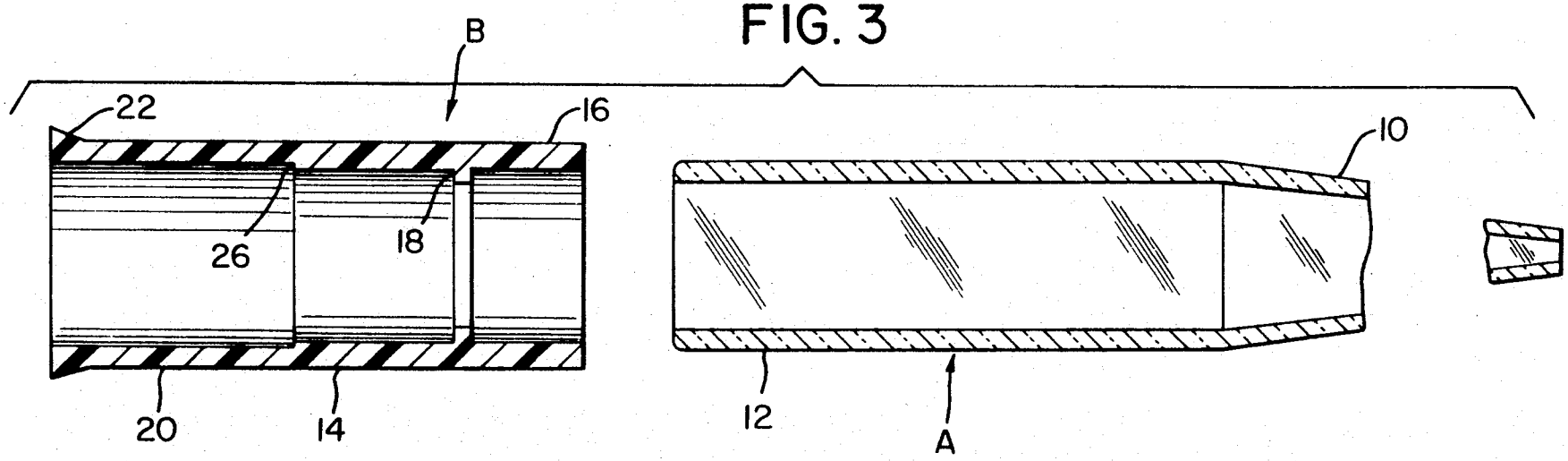
FIG. 3 is an exploded cross-sectional view of the assembly.
Figure 4:
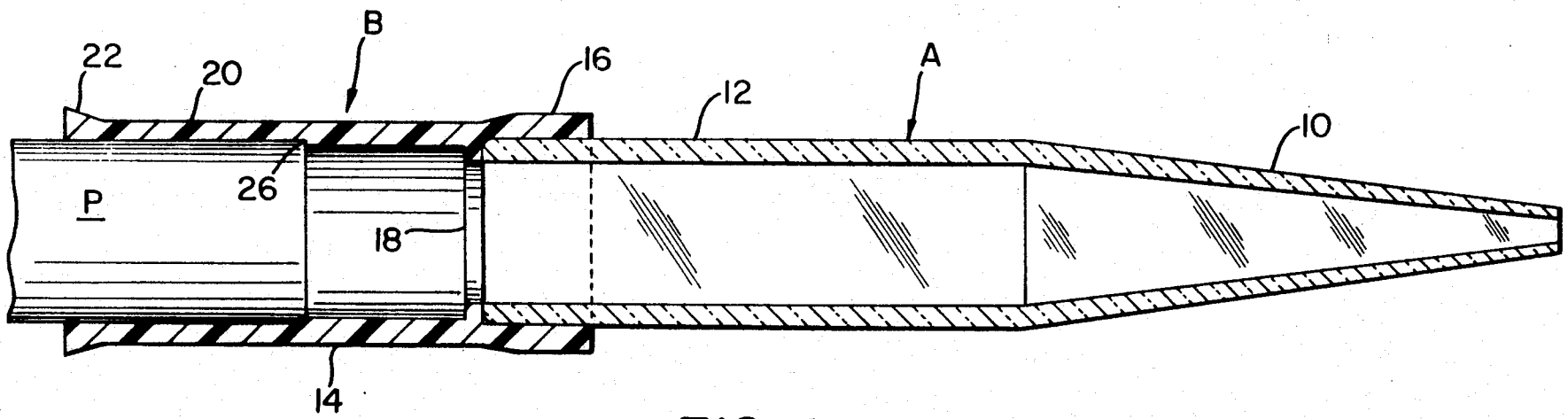
FIG. 4 is a cross-sectional view of the assembly mounted on a pipettor.

As shown in the drawings, the pipet tip assembly of the present invention includes two parts, a glass nozzle, generally designated A, and a plastic collar, generally designated B. Collar B is preferably made of resilient material such as polypropylene, but other plastics may function acceptably, as well.

Nozzle A includes a portion 10 tapered to a relatively fine point and a substantially cylindrical body portion 12. Both ends of nozzle A are preferably fire polished.

Collar B has a cylindrical body 14 with a nozzle receiving end portion 16 defined by an internal annular protrusion or lip 18. The non-tapered end portion of nozzle A is adapted to be friction fitted within end portion 16 of collar B which portion expands slightly to accept the nozzle and to create a fluid tight seal. The end of nozzle A seats against lip 18, which acts as a stop to prevent nozzle A from being inserted too far into collar B.

The other end portion 20 of collar B has an outwardly flared portion at 22. End portion 20 is adapted to receive the end of a pipettor P or the like. It has a slightly larger inner diameter than the remainder of collar B, forming an annular corner 26. Corner 26 functions as a stop to prevent the pipettor end P from being inserted into collar B beyond the corner.

Because nozzle A is made of transparent glass, the liquid level is readily observable from the exterior of the assembly. Therefore, the user can easily prevent the liquid from contacting the plastic collar. Further, the collar can be color coded to indicate a particular size, if desirable.

It will now be appreciated the present invention relates to a combination glass and plastic pipet tip assembly which is inexpensive enough to be disposable, is less fragile than all glass pipet tips and can be used with organic solvents or other liquids, normally not useable with pipet tips made of plastic.

While only a single preferred embodiment of the present invention has been disclosed for purposes of illustration, it is obvious that many variations and modifications could be made thereto. It is intended to cover all of these variations and modifications which fall within the scope of the invention as defined by the following claims:

We claim:

1. A pipette tip assembly comprising a glass nozzle and a resilient plastic collar, said nozzle comprising a substantially cylindrical body having a first body end portion with a first rim and a second body end portion, aid first body end portion having an exterior surface with given outer diameter, said second body end portion being tapered, said collar comprising a substantially cylindrical body having a first collar end portion for mounting the assembly on a pipettor end and a second collar end portion for receiving said first body end portion, said first collar end portion being outwardly flared and adopted to receive the pipettor end, means in said first collar end portion to prevent insertion of the pipettor end into said collar beyond said first collar end portion, said second collar end portion comprising an interior surface and a second rim, said interior surface of said second collar end portion having a diameter slightly smaller than said outer diameter of said first body end portion such that said second collar end portion expands when said first body end portion is received therein, means protruding from said interior surface of said second collar end portion, at a location spaced from said second rim, said first body end portion being adapted to be received within said second collar end portion with said first rim proximate said protruding means.

2. The assembly of claim 1 wherein said collar is comprised of polypropylene.

* * * * *